US005991587A

United States Patent [19]

Kikuchi

[11] Patent Number: 5,991,587

[45] Date of Patent: Nov. 23, 1999

[54] DEVELOPING APPARATUS HAVING DEVELOPING ROLLER WHICH IS LOADED VIA AN INTERMEDIATE ROLLER

[75] Inventor: Susumu Kikuchi, Tokyo, Japan

[73] Assignee: Kyocera Corporation, Tokyo, Japan

[21] Appl. No.: 08/741,270

[22] Filed: Oct. 30, 1996

[30] Foreign Application Priority Data

Oct. 31, 1995 [JP] Japan ..... 7-306951

[51] Int. Cl.[6] ..... G03G 15/08

[52] U.S. Cl. ..... 399/282; 399/285

[58] Field of Search ..... 399/235, 282, 399/285, 234, 273, 283, 264

[56] References Cited

U.S. PATENT DOCUMENTS

| | | | |
|---|---|---|---|
| 4,480,911 | 11/1984 | Itaya et al. | 399/282 |
| 4,508,052 | 4/1985 | Kohyama | 399/282 |
| 4,669,852 | 6/1987 | Tajima et al. | 399/282 |
| 4,686,934 | 8/1987 | Kohyama | 399/282 |
| 5,095,850 | 3/1992 | Komuro | 399/282 |
| 5,341,197 | 8/1994 | Folkins et al. | 399/273 |
| 5,523,826 | 6/1996 | Jugle | 399/284 |
| 5,617,190 | 4/1997 | Takenaka et al. | 399/159 |

FOREIGN PATENT DOCUMENTS 58-070256 4/1983 Japan .

OTHER PUBLICATIONS

Koji Sakamoto, et al. "Mono–Component Development Process ", Ricoh Technical Report No. 16, Jan. 1987, pp. 18–20.

*Primary Examiner*—Robert Beatty
*Attorney, Agent, or Firm*—Loeb & Loeb, LLP

[57] ABSTRACT

An electrophotographic developing apparatus uses a two-component developer comprising a carrier and a toner for development. The apparatus includes an intermediate roller with a non-magnetic sleeve accommodating a magnetic roller disposed between a developing roller and an agitating device for tribo-frictionally charging the carrier and the toner. After forming a magnetic brush consisting of the carrier and the toner, the toner is transferred to the developing roller by applying a first bias to the intermediate roller and the developing roller. A second bias is applied to the developing roller and an image carrier included in the apparatus to cause the toner to selectively attach to the image carrier. A third bias is applied to the developing roller and the intermediate roller to cause the toner to transfer back to the intermediate roller. The intermediate roller has two like polarity poles facing the agitating device and has a peripheral speed which is greater than the developing roller and photosensitive drum.

2 Claims, 7 Drawing Sheets

DEVELOPING APPARATUS HAVING DEVELOPING ROLLER WHICH IS LOADED VIA AN INTERMEDIATE ROLLER

BACKGROUND OF THE INVENTION

1. Field of the Invention

This invention relates to electrophotographic developing apparatuses used with a two-component developer composed of a carrier and a toner and, more particularly, to an electrophotographic developing apparatus, in which the toner is charged by making use of tribo-frictional charging between the carrier and the toner or with a preliminary developing bias to be carried on a developing roller and selectively attached latent image areas (in case of positive development) or non-latent image areas (in case of opposite development) of a photo-sensitive drum or like image carrier.

2. Description of the Prior Art

Electrophotographic developing apparatuses, in which toner is selectively attached to latent image areas (in case of positive development) or non-latent image areas (in case of opposite development) of a photo-sensitive drum or like image carrier, or more specifically dry electrophotographic developing apparatuses, are well known in the art.

Developing apparatuses of this type are largely classified into those based on a uni-component developing process using toner alone as the developer and those based on a two-component developing process using carrier together with toner. They are also classified in dependence on whether the toner used is magnetic, that is, in dependence on whether they are based on a magnetic uni-component (or two-component) developing process or a non-magnetic uni-component (or two-component) developing process.

As an example of the magnetic uni-component developing process, a commonly termed jumping developing process has been proposed (U.S. Pat. No. 4,281,329, U.S. Pat. No. 4,292,387, U.S. Pat. No. 4,395,476 and others). In this process, a thin layer of toner is formed on a developing sleeve and brought to the proximity of the surface of a photo-sensitive drum (or like image carrier), and an AC bias is applied between the two to cause the toner to be attached to an electrostatic image.

In this jumping developing process, however, magnetic forces of a magnet roller which is accommodated in the developing sleeve cause the magnetic brush (to be formed) on the developing sleeve, the magnetic brush to be formed on the developing sleeve, and therefore a high density toner layer cannot be formed. Particularly, in its applications to full-color electrophotography or the like in which toner is attached to the entire transfer sheet surface, sufficient and homogeneous image density cannot be ensured.

The non-magnetic uni-component developing process can be advantageously applied to full-color electrophotographic apparatuses, because it is possible to use toners which are more transparent than magnetic toners. However, because of the use of the non-magnetic toner, no magnetic forces of toner can be used to supply the toner to the developing sleeve. Accordingly, a technique which additionally employs a toner feed roller has been proposed (Ricoh Technical Report, Nos. 16 and 18, 1987). FIG. 7 illustrates this technique. As shown, in this technique a toner feed roller 113 is disposed on an upstream part of a developing sleeve 112 accommodating a magnet roller 111. The magnetic forces of the magnet roller 111 are not effective to attract the toner. However, they act on a toner layer thinning blade 114, which is elastic and magnetic, thus indirectly permitting toner attraction to the developing sleeve 112. Reference numeral 115 designates a discharging brush, 117 a toner agitator, and 116 a toner hopper.

In such non-magnetic uni-component developing process, however, although indirect toner attraction to the developing sleeve 112 on the magnetic toner layer thinning blade 114 is permitted by the magnetic forces of the magnet roller 111, sufficient charge cannot be injected by the agitation of the non-magnetic toner alone by the tribo-frictional charging utilizing the toner agitator 117 or the like. In consequence, a highly dense toner layer cannot be formed on the developing sleeve 112 and, like the above case, it is impossible to ensure sufficient and homogeneous image density in the full-color electrophotography or like applications where toner is attached to the entire transfer sheet surface.

As the two-component developing process, a two-component magnetic brush developing process is usually used. In this process the toner is used together with a carrier, which is constituted by magnetic particles of iron, ferrite, etc. with or without a polymer coating layer or by magnetic fine particles dispersed in a polymer binder. A developer is formed by mixing at a fixed rate the carrier, the diameter of which is set to 50 to 200 $\mu$m, and the toner, the diameter of which is set to smaller than the carrier diameter, for instance 5 to 20 $\mu$m, and a fellow developer is agitated by agitating means to charge the carrier and the toner by tribo-frictional charging. The toner is attached to the carrier surface by electrostatic forces thus generated. Then, the carrier is carried together with the toner on a non-magnetic developing sleeve accommodating a magnet roller, and a magnetic brush is formed on the developing sleeve at a developing position thereof by making use of the magnetic poles (main poles) of the magnet roller.

At the developing position, the toner is selectively attached to latent image areas (in case of positive development) or non-latent image areas (in case of opposite development) on a photo-sensitive drum, by applying a developing bias to the developing position, while causing friction on the photo-sensitive drum with the magnetic brush.

In the magnetic brush developing process of this type, however, the friction of the magnetic brush, which is formed on the developing sleeve and mainly constituted by the carrier, with the photo-sensitive drum surface, is liable to disturb a toner image that is formed in the developing step or cause transfer of the carrier to the photo-sensitive drum to generate white streaks or the like.

As shown above, the magnetic developing process using a magnetic toner is disadvantageous in its applications to full-color electrophotographic apparatuses, because it is impossible to use a toner which is satisfactorily transparent.

Particularly, in the above jumping developing process the toner layer carried on the developing sleeve is low in density, and sufficient and homogeneous image density cannot be ensured in such applications where toner is attached to the entire transfer sheet surface as the full black development, photographic development or full-color development and the like.

In the two-component magnetic brush developing process, although it is possible to use either magnetic or non-magnetic toner, disturbance of a toner image on the side of the photo-sensitive drum may be caused by the friction of the carrier with the toner surface.

SUMMARY OF THE INVENTION

An object of the invention is to provide an electrophotographic developing apparatus, which can readily overcome the drawbacks inherent in the prior art and discussed above with effective combination of the above two-component and uni-component developing processes.

Another object of the invention is to provide an electrophotographic developing apparatus, which permits a high density toner layer to be carried on a developing sleeve even in the case of using an excellently transparent non-magnetic toner for the full-color electrophotography and can ensure sufficient toner density even in the full black development, photographic development, full-color development or like cases of attaching toner on the entire transfer sheet surface.

A further object of the invention is to provide an electrophotographic developing apparatus, which is applicable to a color electrophotographic apparatus having a plurality of developing units provided for a single photo-sensitive drum with effective combination of the two-component magnetic brush developing process and the uni-component jumping developing process.

A still further object of the invention is to provide an electrophotographic developing apparatus, which permits toner density control and other developing condition controls by a simple bias control.

A yet further object of the invention is to provide an electrophotographic developing apparatus, which permits on-off control of the toner supply to an image carrier without such a mechanical control as development gap alienation but by a simple bias control.

As shown in FIG. 1, the invention features an electrophotographic developing apparatus used with a commonly called two-component developer composed of a carrier and a toner both accommodated in a developer vessel 30, wherein:

an intermediate roller 32 including a non-magnetic sleeve 32*a* accommodating a magnet roller 32*b* is disposed between a developing roller 33 for selectively attaching the toner to an image carrier 9 and an agitating means 31 for tribo-fractional charging the carrier and the toner; and after a magnetic brush consisting of the carrier and the toner has been carried on the intermediate roller 32, the toner alone is transferred to the developing roller 33 by making use of a first bias (or a preliminary developing bias) applied between the intermediate roller 32 and the developing roller 33.

According to the invention, only a high density toner layer is carried on the developing roller 33 by the commonly termed two-component magnetic brush development up to a preliminary developing step dealing with the developing sleeve noted above.

In a regular developing step of causing toner to be selectively attached from the developing roller 33 to the image carrier 9, a second bias (i.e., regular developing bias) is applied between the developing roller 33 and the image carrier 9 to cause jumping the toner. In this way, the development is effected.

Since the high density toner thin layer is formed on the developing roller 33 in the preliminary developing step by using the two-component magnetic brush developing process and at the developing position the toner is caused to jump for the development to the image carrier 9 by the regular developing bias, it is possible to ensure sufficient density even in high density image formation by causing toner to be attached to the entire transfer sheet surface, such as the full black image development, photographic development or full-color development.

The magnetic brush of the carrier sufficiently charges the toner by tribo-frictional charging to let the charged toner be carried as a thin film on the developing roller 33. A high density toner layer thus can be carried on the developing roller 33 even in the case of using an excellently transparent, non-magnetic toner, which is effective for the full-color electrophotography.

According to the invention, even by using a two-component developer, at the developing position the toner is caused to jump for the development. It is thus possible to form more sharp image, and the invention is readily applicable to a color electrophotographic apparatus, in which a plurality of developing units are provided for a single photo-sensitive drum.

In view of the charging of the toner, the invention thus features an electrophotographic developing apparatus used with a carrier and a toner both accommodated in the developer vessel 30, wherein:

the intermediate roller 32 including the non-magnetic sleeve 32*a* accommodating the magnet roller 32*b* is disposed between the developing roller 33 for selectively attaching the toner to the image carrier 9 and the agitating means 31 for tribo-frictional charging the carrier and the toner; and after the first charging of the toner has been done by the agitating means 31, the magnetic brush consisting of the carrier and the toner is carried on the intermediate roller 32, and while effecting the second charging of the toner by making use of the magnetic brush, oppositely charged toner between the intermediate roller 32 and the developing roller 33 is separated to let positively charged toner be transferred to the developing roller 33.

Referring to FIG. 1, between the agitating means 31 and the intermediate roller 32 the toner is charged by tribo-frictional charging caused by the agitating means 31 (i.e., mixing agitator), and then the sufficient charging is obtainable because of a second charging making use of the magnetic brush.

Since the toner transfer between the intermediate roller 32 and the developing roller 33 is done by the agency of a bias, for instance, oppositely charged toner (i.e., toner which is charged such as to be attached to the background part of the image carrier) is not transferred to the developing roller 33 but is held on the intermediate roller 32.

In other words, it is possible to separate the oppositely charged toner and let only the positively charged toner be transferred to the developing roller 33, that is, it is possible to obtain a charging filter effect.

Thus, at the developing roller 33 side, only the positively charged toner which can contribute to the image formation, is carried on the developing roller 33 to be used for the development. It is thus possible to obtain a fog-free sharp toner image as a result of the development.

A further feature of the invention resides in that the applied voltage of the first bias is capable of being switched when doing development and when doing no development, permitting toner transfer from the intermediate roller 32 to the developing roller 33 when doing development and on the other hand toner recovery from the developing roller 33 to the intermediate roller 32 when doing no development.

Since the toner recovery is made from the developing roller 33 to the intermediate roller 32 when doing no development, it is not possible that an image hysteresis is generated on the image carrier 9. Particularly, it is thus possible to on-off control the toner supply to the image carrier 9 without such mechanical control as causing alienate from the developing gap but by merely making a bias control. This is particularly useful in the case where a plurality of developing units of different toner colors are provided around a single photo-sensitive drum.

In this case, ready bias switching when doing development and when doing no development is obtainable with an AC bias with a superimposed DC component as the second bias and on the other hand with a DC bias as the first bias.

More specifically, suitably the DC voltage level of the first bias is made switchable when doing development and when doing no development such that it is higher than the superimposed DC component level of the second bias when doing development and lower than the superimposed DC component level of the second bias when doing no development.

More clearly, where the bias voltage serves as a positive bias when its polarity is the same as that of the toner used and as an opposite bias when its polarity is opposite, suitably the first bias is switchable to the positive bias when doing development and to the opposite bias when doing no development.

In this case, readier toner recovery from the developing roller 33 is obtainable when the DC component of the second bias is the positive bias.

In view of attenuating the toner fatigue, the absolute values of the positive and opposite biases as the first bias when doing development and when doing no development, are suitably in a range of 150 to 500 V.

Suitably, the second bias which is an AC bias with a superimposed DC component, is such that the AC bias is a sinusoidal wave or a rectangular wave, has a peak-to-peak value ACpp of 2.4 to 1.2 Kv and a frequency ACHz of 2.5 to 1.5 KHz. With this bias, smooth electric field vibrations of toner is obtainable, thus permitting development at a higher speed.

Suitably, the DC component of the second bias is Vo (potential level to which the image carrier 9 is charged) ±100 V in the positive developing process in which toner is attached to latent image areas of the image carrier 9, and V1 (surface potential on the image carrier 9) ±100 V in the opposite developing process in which toner is attached to non-image areas of the image carrier 9.

Adjustment of the thickness of the toner layer carried on the developing roller 33 can be obtained with an arrangement that the potential difference between the first bias and the preliminary developing bias is variable when doing development. The toner density or the like thus can be readily controlled.

Suitably, the volume resistivity of the carrier is set to $10^7$ to $10^{12}$ Ω·cm, more specifically a carrier with a volume resistivity of $10^{10}$ Ω·cm or below and a carrier with a volume resistivity of $10^{12}$ Ω·cm or above are used as a mixture.

DETAILED DESCRIPTION OF THE PREFERRED EMBODIMENT

Figure 1:
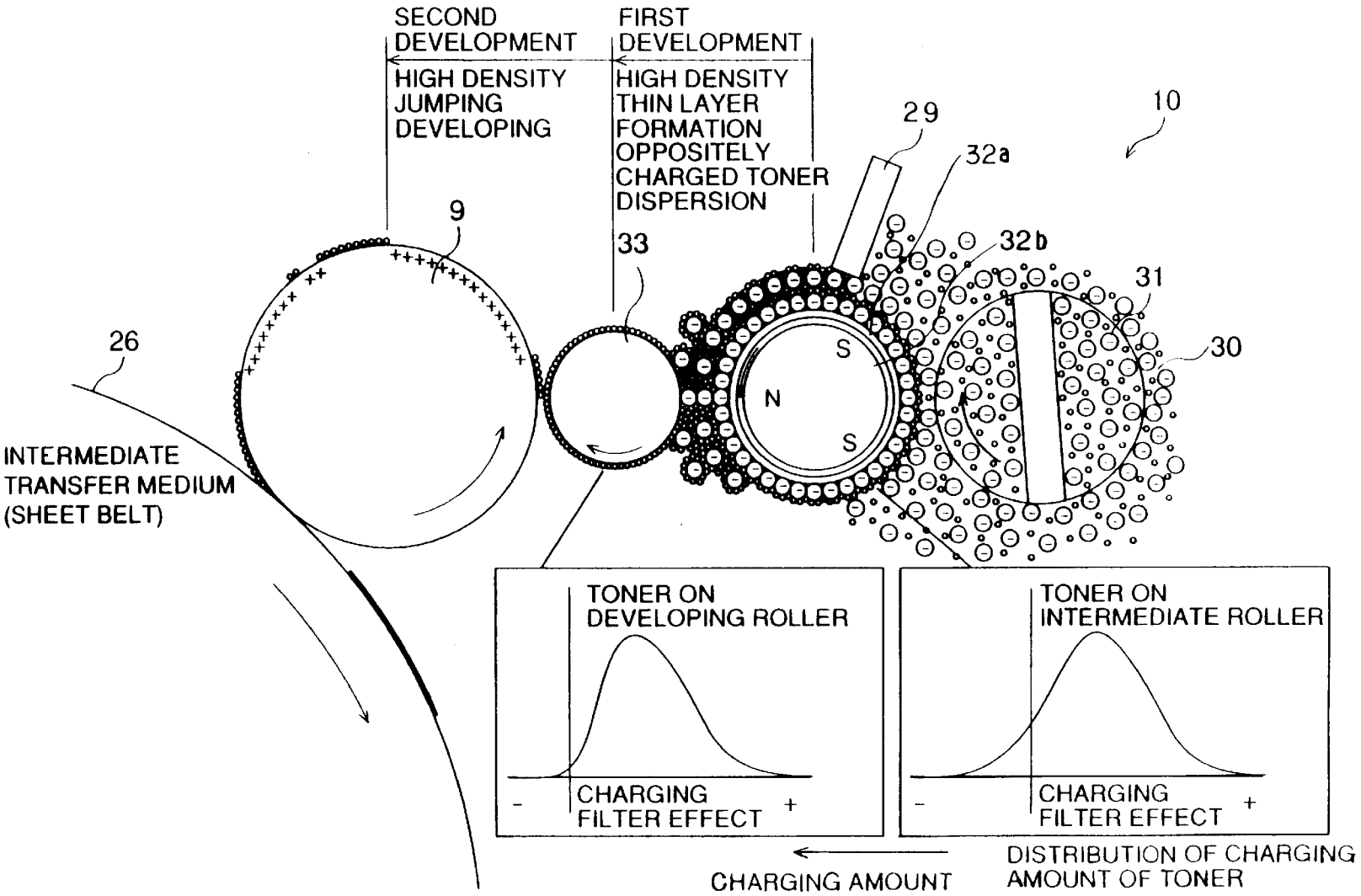
FIG. 1 is a view illustrating the basic operation of an electrophotographic developing apparatus having a basic construction according to the invention.

A preferred embodiment of the invention will now be described with reference to the drawings. It is to be construed that unless particularly specified, the dimensions, materials, shapes, relative dispositions and so forth of the constituent parts described in the embodiment are by no means limitative but are merely exemplary.

The invention will first be described with reference to FIG. 1. Reference numeral 10 designates a developing unit, 9 an image carrier like a photo-sensitive drum, and 26 an intermediate transfer medium (i.e., sheet shaped belt). In a developer vessel 30 which constitutes the developing unit 10, an intermediate roller 32 including a non-magnetic sleeve 32*a* accommodating a magnet roller 32*b*, is disposed between a developing roller 33 for selectively attaching toner to a photo-sensitive drum 9 and a mixer 31 for causing tribo-frictional charging of carrier and toner. A DC bias is applied as a preliminary developing bias to the intermediate roller 32, and an AC bias with a superimposed DC component is applied to the developing roller 33 (not shown in the drawing).

Figure 3:
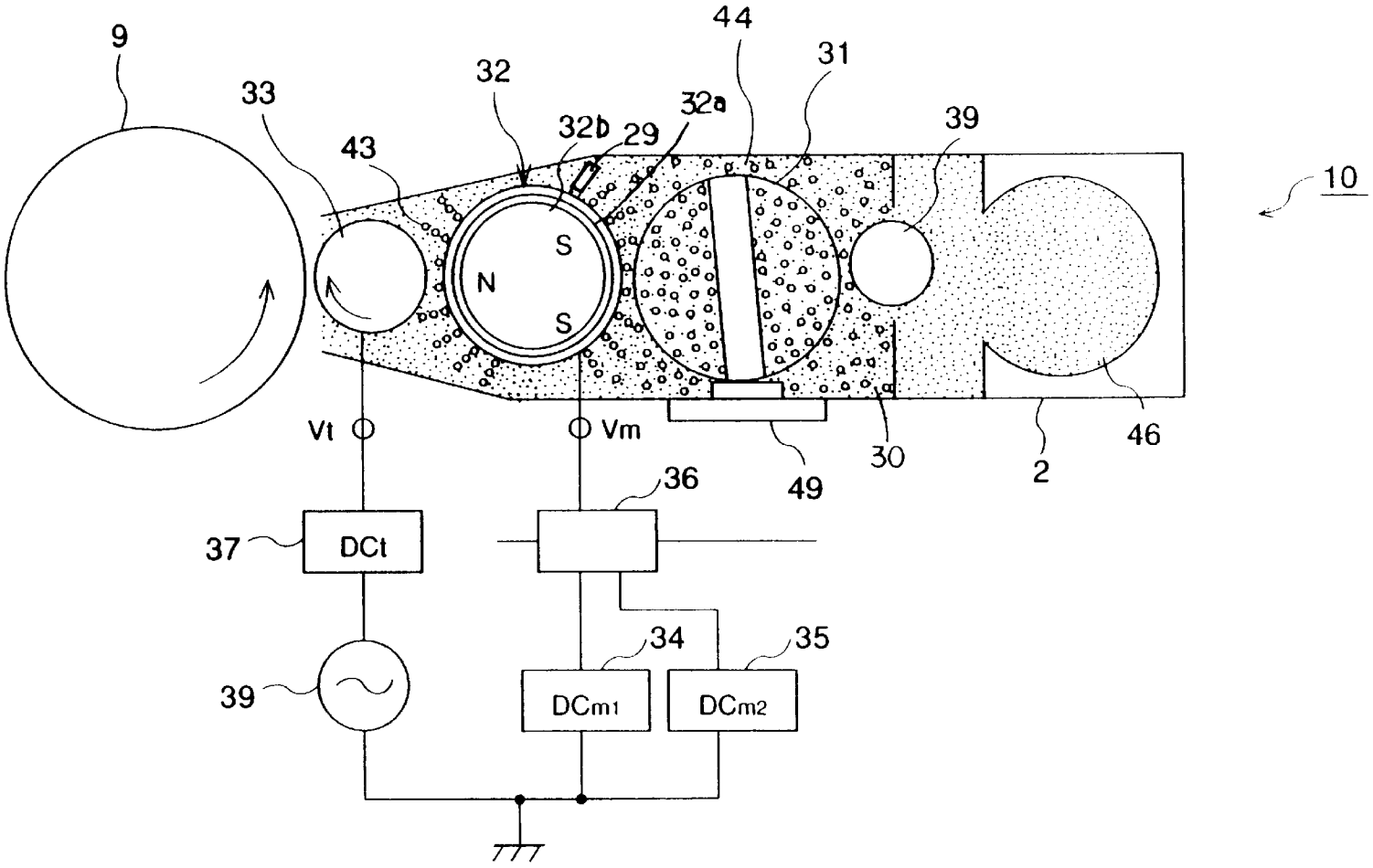
FIG. 3 is a schematic view showing an embodiment of the developing apparatus according to the invention.

In the case of the opposite development as shown in FIG. 3, for instance, in which the charged (or background) potential level on the photo-sensitive drum 9 is positive, the carrier 43 and the toner 44 are tribo-frictional charged positively and negatively, respectively, by the agitating rotation of the mixer 31. Thus, the carrier which is in the form of magnetic particles, is carried with the toner electrostatically attached thereto as a magnetic brush on the surface of the intermediate roller 32 rotating in the direction of arrow.

Denoting the regular developing bias voltage applied to the developing roller 33 by Vt and the preliminary bias voltage applied to the intermediate roller 32 by Vm, transfer of the toner attracted to the magnetic brush carrier on the intermediate roller 32 to the developing roller 33 takes place when Vt<Vm, and toner recovery from the developing roller 33 to the intermediate roller 32 takes place when Vt>Vm.

Figure 2:
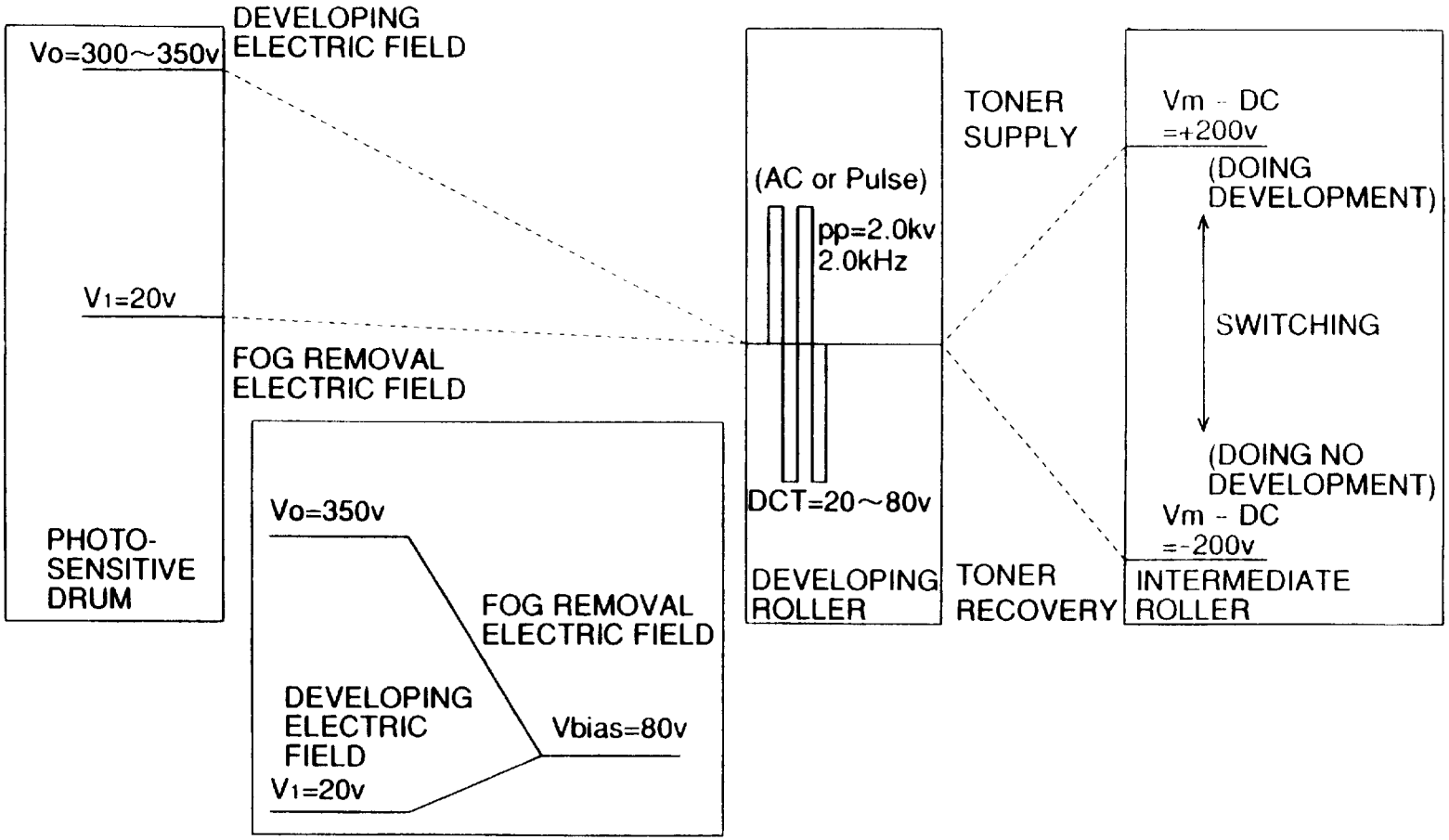
FIG. 2 is a view showing the biases applied to an intermediate roller and a developing roller and the surface potential on a photo-sensitive drum in the developing apparatus shown in FIG. 1.
Figure 4:
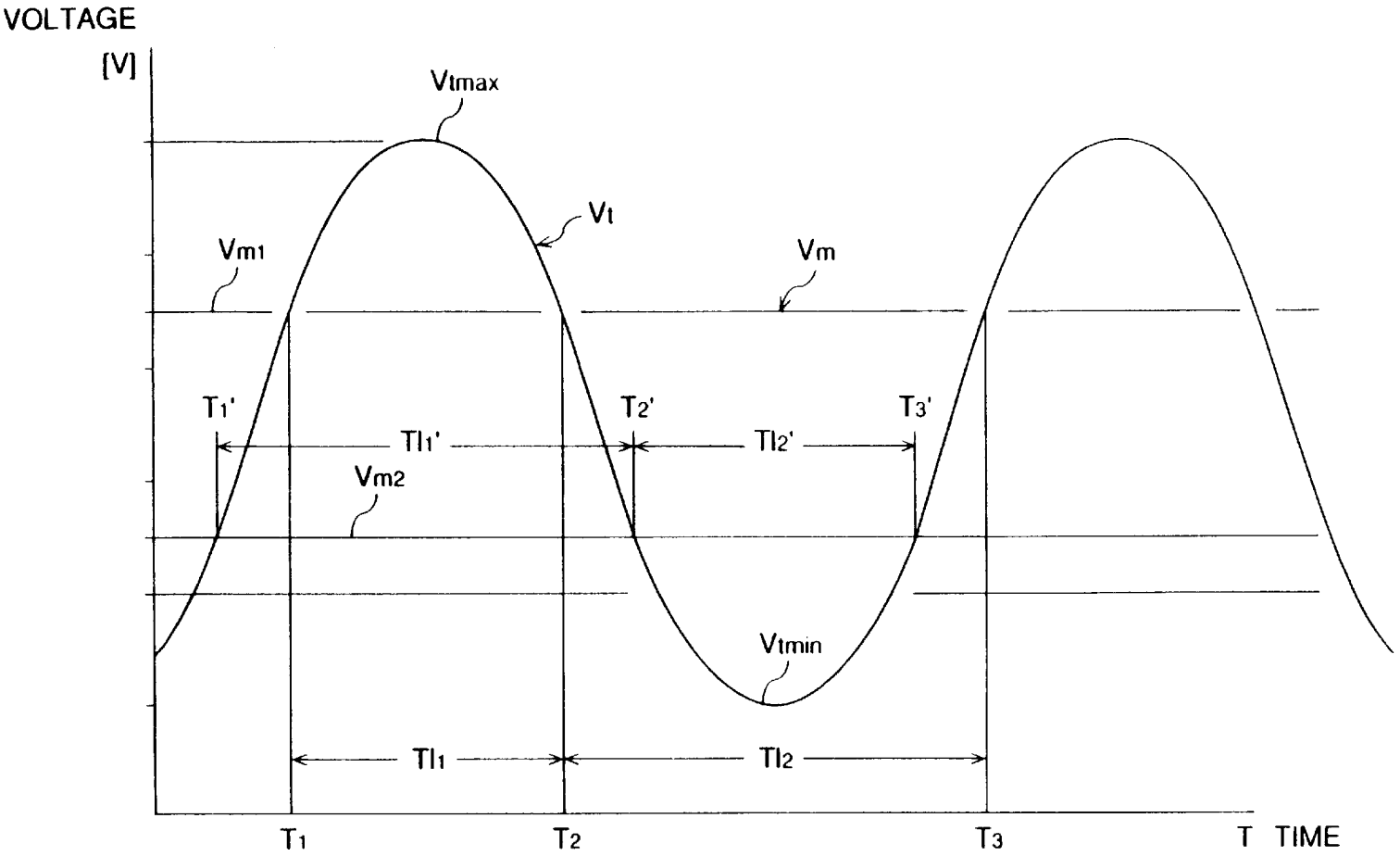
FIG. 4 is a graph illustrating the transfer of toner from the intermediate roller to the developing roller and the recovery of toner form the developing roller to the intermediate roller, these states being brought about by the potential difference between the biases applied to the intermediate roller and the developing roller.

As shown in FIGS. 2 and 4, when the bias Vt applied to the developing roller 33 is an AC bias with a superimposed DC voltage of 20 to 80 V and having a peak-to-peak voltage of 2000 V and a frequency of 2 KHz, while the bias voltage Vm applied to the intermediate roller 32 is set to DC 200 V when doing development, the toner 44 is transferred from the intermediate roller 32 to the developing roller 33 during a period $T1_2$, during which Vt<Vm.

During a period $T1_1$ during which Vt>Vm, the toner 44 is recovered from the developing roller 33 to the intermediate roller 32.

That is, when doing development, during the period $T1_2$, during which the bias voltage Vt on the developing roller 33 is not higher than 200 V, the toner is transferred from the intermediate roller 32 to the developing roller 33. During the period $T1_1$ during which Vt is higher than 200 V, the toner 44 is recovered from the developing roller 33 to the intermediate roller 32. Since the period $T1_2$ is longer than the period $T1_1$, toner layer transfer to the developing roller 33 is obtained.

By switching the bias voltage Vm applied to the intermediate roller 32 to DC −200 V when doing no development, during a period $T1'_2$ during which the bias voltage Vt on the developing roller 33 is not higher than −200 V, the toner 44 is transferred from the intermediate roller 32 to the developing roller 33. During a period $T1'_1$ during which Vt is higher than −200 V, the toner 44 is recovered from the developing roller 33 to the intermediate roller 32. Since the period $T1_2$ is shorter than the period $T1'_1$, toner recovery from the developing roller 33 is obtained.

By arranging such that the potential difference (Vtmax−Vm1) between the maximum value Vtmax of the AC bias voltage Vt and the DC bias voltage Vm1, the toner transfer or recovery period $T1_1$ or $T1_2$ can be varied to very the thickness of the toner layer formed on the developing roller 33. In this way, it is possible to control the toner density or other developing conditions.

Regarding the relation between the photo-sensitive drum 9 and the developing roller 33, by setting the center bias voltage Vbias (i.e., superimposed DC component) applied to the developing roller 33 to be above the surface potential V1 (20 V) on the photo-sensitive drum 9 and below the charged (or background) potential level Vo (300 to 350 V), the toner can be caused to jump for development from the developing roller 33 to the photo-sensitive drum 9.

In this case, since only positively charged toner is carried at a high density on the developing roller 33, smooth development is possible even when the center bias voltage Vbias is made lower toward the surface potential V1 (for instance around 80 V). It is thus possible to get the developing at low electric field and to set a high potential difference (fog removal electric field) between Vbias and Vo to perfectly eliminate toner fog on the background areas.

A full-color electrophotographic printer incorporating the above developing apparatus will now be described.

Figure 5:
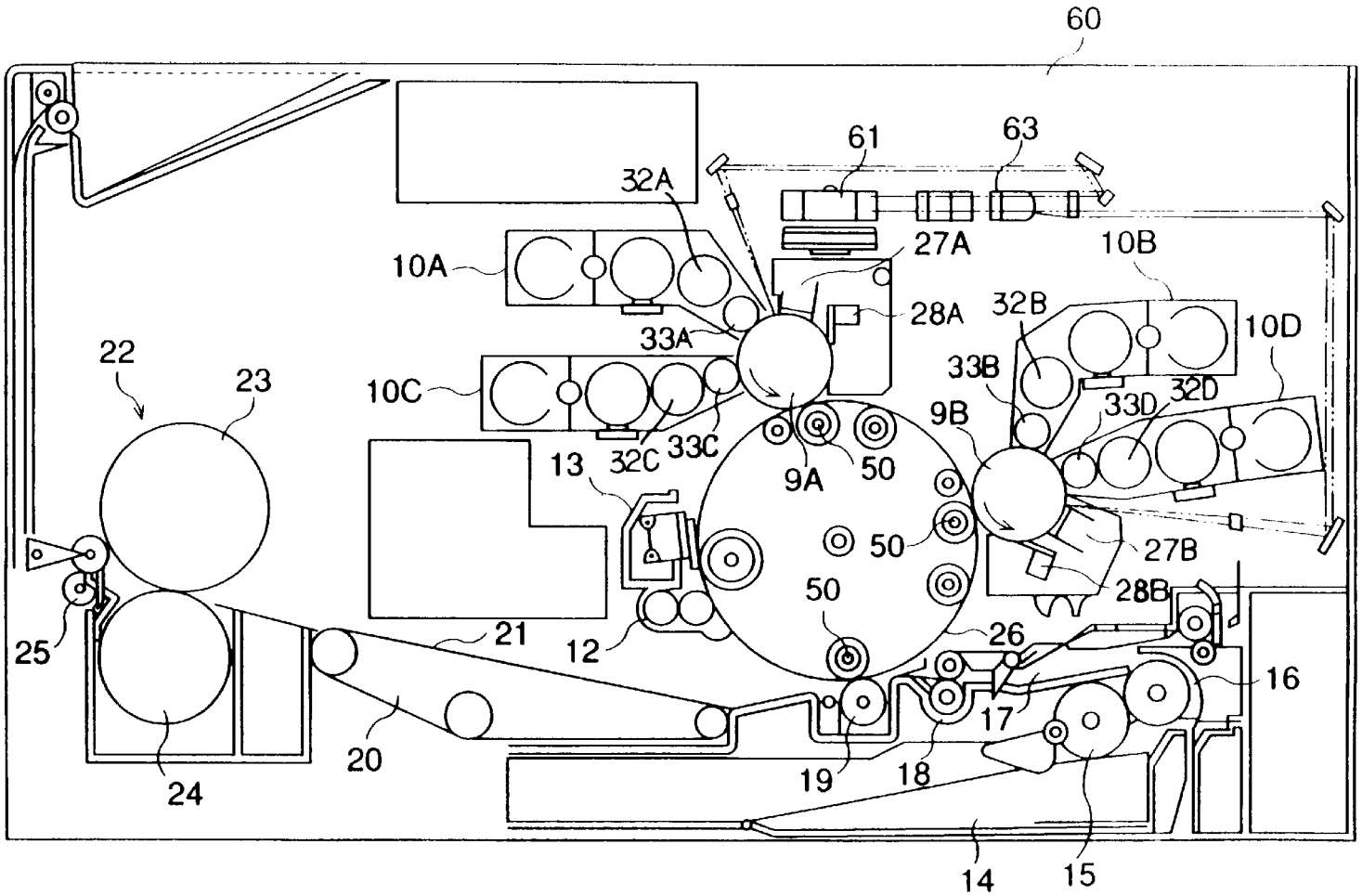
FIG. 5 is a schematic view showing an image forming apparatus, to which the invention is applied.

FIG. 5 is a schematic view showing the full-color electrophotographic printer to which the invention is applied. The printer comprises an optical scanning system 60 of two-beam optical scanning type involving optical signals corresponding to different color toner images. Two modulated light beams from a beam source (not shown) are focused by an optical scanning system 60, which includes polygon mirrors 61, lens systems 63, etc. on respective image carriers 9, i.e., photo-sensitive drums 9A and 9B, to form latent images thereon.

Each of the photo-sensitive drums 9A and 9B is provided with a charger 27 for charging it and a cleaning blade 28 for removing residual toner from it.

The photo-sensitive drums 9A and 9B are in contact at their transfer position with a rotating intermediate transfer sheet belt 26 pushed against them by back side transfer rollers 50. The intermediate transfer sheet belt 26 is an endless belt, which is made of polycarbonate, polyimide, polyether etherketone or like material, has a thickness of about 150 μm and has a volume resistivity in an intermediate range of $10^{10}$ to $10^{14}$ Ω·cm. Reference numeral 12 designates a cleaner for removing residual toner from the intermediate transfer sheet belt 26, and reference numeral 13 designates a residual toner recovery vessel.

The circumferential dimension of the intermediate transfer sheet belt 26 is set to be substantially equal to or longer than the maximum length of the transfer sheet. During one rotation of the intermediate transfer sheet belt 26, a magenta toner from the photo-sensitive drum 9A and a yellow toner from the photo-sensitive drum 9B are transferred in superimposition on each other via respective transfer rollers 50. During the next rotation of the intermediate transfer sheet belt 26, a black toner from the photo-sensitive drum 9A and a cyan toner from the photo-sensitive drum 9B are transferred in superimposition on each other. In this way, the four different color toners are carried in superimposition on one another on the intermediate transfer sheet belt 26.

More specifically, a black and a yellow toner developing unit 10A and 10B are provided around the photo-sensitive drum 9A, and a magenta and a cyan-yellow developing unit 10C and 10D are provided around the photo-sensitive drum 9B. Each of the developing units 10A to 10D alternately does and does not do development by controlling the biases applied to the developing roller 33 and the intermediate roller 32 for every rotation of the intermediate transfer sheet belt 26.

The developing units 10A to 10D have their developing rollers 33 disposed around the associated photo-sensitive drums 9A and 9B without contact therewith but with a slight clearance provided.

The toners used with this embodiment are non-magnetic high resistivity toners with an average diameter of 5 to 20 μm. The toner layer carried on the developing roller 33 is made by the bias control to be 1.5 to 2.5 times the amount of the toner transferred to the photo-sensitive drum. The absolute value of the average charging level of toner is set to 5 to 20 μQ/mg.

The carrier used is in the surface of magnetic particles with silicon coating on a ferrite core with a polyethylene polymerized laminate coating, and has a volume resistivity of $10^7$ to $10^{12}$ Ω·cm. Preferably, a mixture of a carrier with a volume resistivity of $10^{10}$ Ω·cm or below and a carrier with a volume resistivity of $10^{12}$ Ω·cm or above is used. More specifically, preferably the carrier with the volume resistivity of $10^{12}$ Ω·cm or above is contained by 10% by weight or above, specifically by 10 to 40% by weight.

As shown in FIG. 1, the magnet composite roll accommodated in the intermediate roller 32 has one main pole (i.e., N pole) on its side of the developing position but it may has two main poles (N poles) on such position that it is closest to the developing roller 33 and the intermediate roller 32 between these two main poles (N poles), and even though the main pole might be one or two, the intermediate roller 32 has the main pole(s) (N pole(s)) within an upstream side angle of 6 degrees and a downstream side angle of 12 degrees, respectively, from its point closest to the developing roller 33.

Suitably, the carrier is the magnetic particle dispersion polymerized carrier with an average diameter of 70 μm or above, and the maximum main pole magnetic force is 650 Gauss or above.

Also suitably, the developing roller 33 has a diameter of ϕ 10 to 6 mm, the bias applied to the intermediate roller 32 is a sinusoidal wave or a rectangular wave and has ACpp=2.4 to 1.2 Kv and ACHz=2.5 to 1.5 KHz, and the developing gap between the photo-sensitive drum 9 and the developing roller 33 is 0.3 to 0.2 mm.

The gap between the developing roller 33 and the intermediate roller 32 is set to 0.85 mm, and the gap between the intermediate roller 32 and the restricting member 29 is set to 0.90 mm.

Yet suitably, a comminuted toner with an average diameter of about 7 microns and using a polyester resin as a main binder is added to the laminated coated carrier in a ratio of 95:5±2, and the peripheral speed of the intermediate roller 32 is set to 2 to 5 times, preferably 2.5 to 3 times, to the peripheral speed of the developing roller 33.

When the four different color toners have been transferred in superimposition on one another onto the intermediate transfer sheet belt 26, a transfer sheet accommodated in a sheet cassette 14 is fed out by a sheet feed roller 15 to be led along sheet feed paths 16 and 17 and brought to an inlet adjacent a resist roller 18. After the superimposition transfer of the four different colors, the resist roller 18 is rotated in a timed relation to the leading image end to bring the transfer sheet to a transfer position between the intermediate transfer sheet belt 26 and a second transfer roller 19 and effect transfer of the four-color toner image onto the transfer sheet. The transfer sheet with the before-fixing transfer image transferred thereto, is conveyed on a conveyor belt 21 of a conveying unit 20 to a fixing unit 22.

In the fixing unit 22, the toner image is thermally fixed in its nipped state between a fixing roller 23 and a press roller 24, and then the transfer sheet is discharged by a discharge roller 25 to the outside.

Now, the developing apparatus 10 which is assembled in the above electrophotographic printer will be described.

As shown in FIG. 3, the developing apparatus 10 comprises a rectangular housing, which has an opening facing the photo-sensitive drum 9 and accommodates a toner tank 46 on the side opposite the opening. Toner 44 of the pertinent color is supplied to the toner tank 46. The housing also accommodates a carrier/toner mixer 31, and a toner sensor 49 provided there below detects the carrier-to-toner ratio. When the detected carrier-to-toner ratio becomes lower than a predetermined ratio, a toner replenishment roller 39 is rotated to replenish the side of the mixer 31 with toner, thus maintaining the carrier-to-toner ratio constant.

Carrier and toner are mixed uniformly by the mixer 31. At this time, the carrier 43 is charged positively, and the toner 44 is charged negatively.

An intermediate roller 32 accommodating a magnet roller 32B is provided adjacent the mixer 31. A regulating member 29 for regulating the thickness of the carrier 43 with the toner 44 electrostatically attracted thereto, is provided on the outer periphery of the intermediate roller 32.

Because of the magnet roller 32*b* accommodated in the intermediate roller 32, the carrier 43 regulated the thickness thereof forms a magnetic brush on the surface of intermediate roller 32.

A DC power supply (DCm1) 34 for doing development and a DC power supply (DCm2) 35 for doing no development, can be switchedly coupled via a voltage switching circuit 36A to the intermediate roller 32.

That is, the voltage switching circuit 36A switches the DC power supply (DCm1) 34, i.e., 200 V, and the DC power supply (DCm2) 35, i.e., −200 V, when doing development and when doing no development.

To a developing roller 33 which faces the intermediate roller 33 at a predetermined distance therefrom is applied, as a bias voltage, a voltage of an AC power source 39 with a superimposed DC voltage (DCt) 37 (i.e., regular developing bias).

When doing development with the DC power supply (DCm1) 34 coupled, the toner 44 is transferred from the intermediate roller 32 to the developing roller 33 to form a thin layer of toner by making use of the potential difference of the bias voltage.

When doing no development with the DC power supply (DCm2) 35 coupled, the toner 44 is transferred for recovery from the developing roller 33 to the intermediate roller 32 by making use of the potential difference of the bias voltage.

The developing roller 33 faces the photo-sensitive drum 9 at a slight distance therefrom and is rotatable at a higher peripheral speed than the peripheral speed of the photo-sensitive drum 9. The regular developing bias applied causes toner to be attached to non-latent image areas (V1) of the photo-sensitive drum 9A. In this way, a predetermined development is obtained.

As described before, suitably the regular developing bias voltage Vt applied to the developing roller 33 consists of a DC voltage of 20 to 80 V and an AC voltage ACpp of 2.4 to 1.2 Kv, the AC voltage frequency ACHz is 2.5 to 1.5 KHz, and the development gap is 0.3 to 0.2 mm.

The bias voltage Vt applied to the developing roller may not be sinusoidal, and it may be a variable amplitude pulse wave.

The adjustment of the developing conditions including the toner density, may be made by adjusting the bias voltage (DCm1) 34 applied to the intermediate roller 32 or adjusting the bias voltage Vt applied to the developing roller 33.

As shown in FIG. 4, the voltage difference (Vtmax−Vm1) between the maximum value Vtmax of the regular developing bias voltage and the preliminary developing bias voltage Vm1, can be varied by varying Vtmax. This can be done so by varying the peak-to-peak value of the AC power source providing Vt or varying the DC power supply DCt superimposed on the AC power source.

The voltage difference (Vtmin−Vm1) between the minimum value Vtmin of the regular developing bias voltage and the preliminary developing bias voltage Vm1, can be varied by varying Vtmin. This can be done so by varying the peak-to-peak value of the AC power source providing Vt or varying the DC power supply DCt superimposed on the AC power source.

By varying the voltage difference (Vtmax−Vm1) or (Vtmin−Vm1), the toner transfer or recovery period $T1_1$ or $T1_2$ shown in FIG. 4 can be varied to vary the thickness of the toner layer formed on the developing roller 33. In this way, it is possible to control the developing conditions of the developing unit.

Thus, in this embodiment only the thin layer of toner is transferred from the intermediate roller 32 to the developing roller 33, and no carrier is introduced to the developing roller 33. In addition, toner around toner missing areas on the photo-sensitive drum 9A after the development, is scraped off by the magnetic brush, and always fresh toner is transferred from the intermediate roller 32. Moreover, charged memory toner is recovered to the intermediate roller 32, causing vanishing of the memory toner image around the toner missing areas so that no image is formed again. It is thus possible to eliminate ghost and provide images which are sharp and have excellent contrast.

Figure 6:
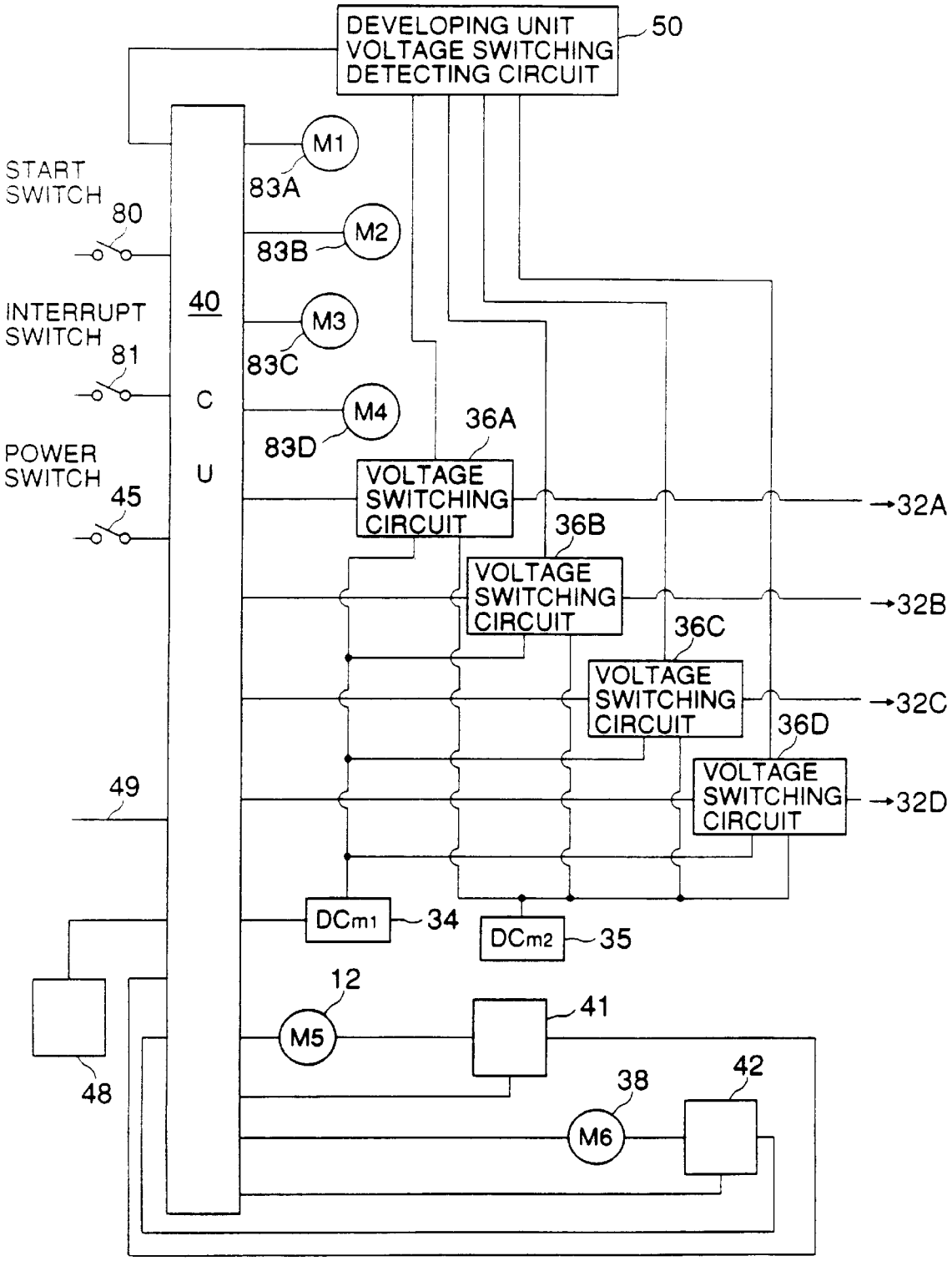
FIG. 6 is a block diagram showing a circuit used according to the invention.
Figure 7:
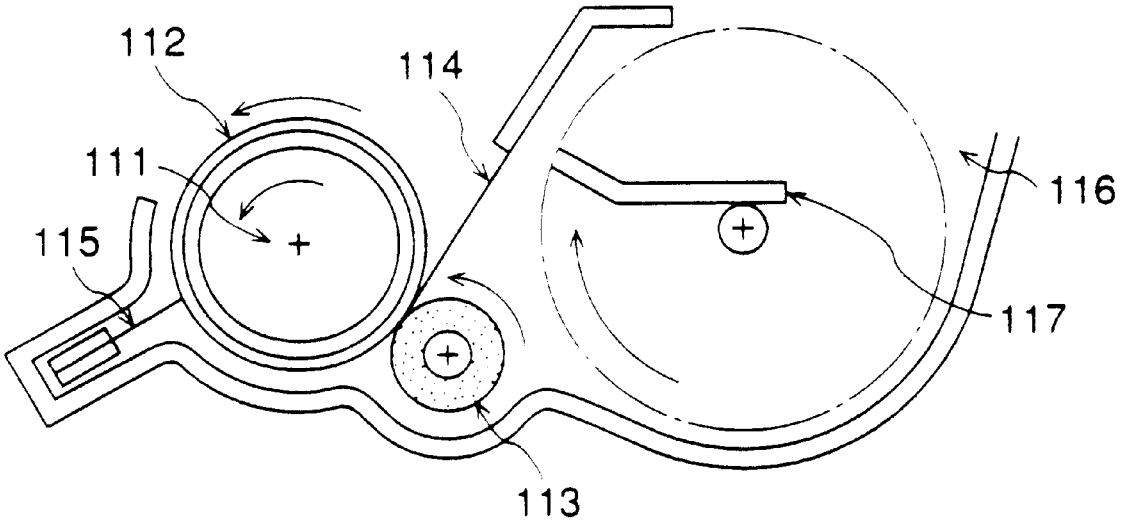
FIG.7 ( PRIOR ART )
FIG. 7 is a schematic view showing a prior art developing apparatus.

FIG. 6 shows the circuit construction of the embodiment of the invention having the mechanical construction as described above.

CU (a control unit) 40 is constructed such that it can receive signals from a start switch 80 for starting the printing in the full-color electrophotographic printer as described above, an interrupt switch 81 for interrupting the printing operation, and a power switch 45.

The CU 40 provides output signals for controlling motors (M1) 83A, (M2) 83B, (M3) 83C and to (M4) 83D for driving the developing rollers 33, magnet rollers 32, mixers 31 and toner replenishment roller 39 in the developing units 10A to 10D according to detection signals from the toner sensors 49.

Voltage switching circuits 36A to 36D can switch DC bias supplies 34 and 35 according to commands from the CU 40 for each rotation of the intermediate transfer drum belt 26.

The voltage of the DC bias supply 34 is variable according to command from the CU 40 for toner density control.

The voltage switching circuits 36A to 36D provide detection voltages to a developing unit voltage detecting circuit 50, which monitors the output voltages from the voltage switching circuits 36A to 36D under control of the CU 40.

The CU 40 further provides an output signal for controlling a motor control circuit for controlling a motor (M5) 12, which drives the intermediate transfer sheet belt 26 and the photo-sensitive drums 9A and 9B. To the motor 12 is coupled a rotational speed detecting means 41, which is reset by the start signal and the interrupt signal and detects the rotational speed of the motor.

To the CU 40 is connected a polygon mirror motor (M6) 38 which drives the polygon mirror. To the output terminal of the motor 38 is connected another rotational speed detecting means 42, which is reset by the start signal and the interrupt signal and detects the rotational speed of the motor 38.

The operation of the embodiment having the above construction will now be described in detail.

When the start switch 80 is closed, the CU 40 sends out output signals to cause rotation of the motors M1 to M5 so as to cause rotation of the various mechanisms in the developing units, as well as resetting the rotational speed detecting means 41 for detecting the rotational speeds of the photo-sensitive drums 9A and the intermediate transfer sheet belt 26, the photo-sensitive drums 9A and the intermediate transfer sheet belt 26 thus starting rotation.

The voltage switching circuit 36A checks whether the DC power supply 34 (200 V, which is the level when doing development) is coupled to the developing units 10A and 10C and the DC power supply 35 (−20 V, which is the level when doing no development) is coupled to the developing units 10B and 10D. In the developing units 10A and 10C to which the bias voltage of the level when doing development is coupled, toner is transferred for development from the intermediate roller 32 to the developing roller 33. In the developing units 10B and 10D to which the bias voltage of the level when doing no development is applied, toner is recovered from the developing roller 33 to the intermediate roller 32. In this case, no development is done.

The CU 40 drives the polygon mirror motor (M4) 38 causes light images corresponding to magenta and yellow toner images to be focused on the corresponding photo-sensitive drums 9.

Residual toner is removed from the photo-sensitive drums 9A by the cleaning blades 28A, and then the photo-sensitive drums 9A are charged by the chargers 27A. Electrostatic latent images corresponding to magenta and yellow are formed on the charged photo-sensitive drums 9A by the optical system 60, and the developing units 10A and 10C do development to form the magenta and yellow toner images.

The magenta toner image formed on the photo-sensitive drum 9A is transferred by the transfer roller onto the intermediate transfer sheet belt 26, and then the yellow toner image formed on the photo-sensitive drum 9B is transferred in superimposition on the magenta toner image on the intermediate transfer sheet belt 26.

After the transfer of the magenta and yellow toner images for one transfer sheet onto the intermediate transfer sheet belt 26, the CU 40 sends out an output signal to the voltage switching circuit 36A to switch the bias voltage applied to the intermediate rollers 32 in the developing units 10A and 10C to the level (−200 V) when doing no development, and switch the bias voltage applied to the intermediate rollers 32 in the developing units 10B and 10D to the level (200 V) when doing development. Then, the photo-sensitive drum 9B do for development to form cyan and black toner images. These cyan and black toner images are transferred onto the intermediate transfer sheet belt 26 in superimposition on the previously transferred cyan and yellow toner images.

When the four different color toner images have been transferred onto the intermediate transfer sheet belt 26, a transfer sheet accommodated in the sheet cassette 14 is fed out by the sheet feed roller and led along the sheet feed paths 16 and 17 to the inlet adjacent the resist roller 18. After the four different color toner images have been transferred, the resist roller 18 is rotated in a timed relation to the leading image end to bring the transfer sheet to the transferring position between the intermediate transfer sheet belt 26 and the seconds transfer roller 19, and the four-color toner image is transferred onto the transfer sheet. The transfer sheet with the before-fixing toner image transferred onto it is conveyed on the conveyor belt 21 of the conveying unit 20 to the fixing unit 22.

In the fixing unit 22, the toner image is thermally fixed in the state of nip between the fixing roller 23 and the press roller 24. The transfer sheet is then discharged by the discharging roller 25 to the outside.

As has been described in the foregoing, according to the invention the two-component developing process and the uni-component developing process are effectively combined to permit, in the case of using even a highly transparent non-magnetic toner, a high density toner layer to be carried on the developing roller, and also ensure sufficient toner density in the full black image development, photographic development, full color development or like cases where toner is attached to the entire transfer sheet surface.

The invention is also readily applicable, by effectively combining the two-component magnetic brush developing process and the uni-component jumping developing process, to a color electrophotographic apparatus, which comprises a plurality of developing units provided for one photosensitive drum with different color toners attached thereto in a previous step.

According to the invention it is further possible to obtain toner density control or other developing condition controls with a simple bias control.

Moreover, according to the invention it is possible to permit on-off control of toner supply to an image carrier without developing gap alienation or like mechanical control but by a simple bias control.

What is claimed is:

1. An electrophotographic developing apparatus comprising:

a developer vessel accommodating a carrier and a toner;

agitating means for tribo-frictionally charging the carrier and the toner;

a developing roller for causing selective attachment of the toner to an image carrier;

an intermediate roller including a non-magnet sleeve accommodating a magnet roller, said intermediate roller being disposed between said developing roller and said agitating means and having a pair of magnetic poles of like polarity at a side of the intermediate roller facing the agitating means and forming a magnetic brush adjacent a surface of the agitating means and comprised of the carrier and the toner;

toner transferring means for causing, after the magnetic brush comprised of the carrier and the toner has been carried on said intermediate roller, transfer of the toner alone to said developing roller by making use of a DC bias developed between said intermediate roller and said developing roller;

developing means for making development by causing jumping of the toner by applying an AC bias having a superimposed DC component between said developing roller and said image carrier;

DC bias switching means for switching said DC bias when developing and when not developing; and said DC bias switching means causing when developing switching of the voltage level of said DC bias to be higher than the voltage level of said superimposed DC component of said AC bias, thereby causing the toner to undergo transfer motion between said intermediate roller and said developing roller to be transferred to said developing roller, and when not developing, switching of the voltage level of said DC bias to be lower than said superimposed DC component of said AC bias, thereby causing the toner to undergo recovery motion between said intermediate roller and said developing roller to be recovered to said intermediate roller.

2. An electrophotographic developing apparatus comprising:

a developer vessel accommodating a carrier and a toner;

agitating means for tribo-frictionally charging the carrier and the toner;

a developing roller for causing selective attachment of the toner to an image carrier;

an intermediate roller including a non-magnetic sleeve accommodating a magnet roller, said intermediate roller being disposed between said developing roller and said agitating means and having at least one magnetic pole at a side thereof facing the agitating means, the at least one magnetic pole forming a magnetic brush adjacent a surface of the agitating means and comprised of the carrier and the toner, wherein the image carrier comprises a photosensitive drum which is rotatable in a given direction at a first peripheral speed, the developing roller is rotatable in the given direction at a second peripheral speed which is greater than the first peripheral speed, and the intermediate roller is rotatable at a third peripheral speed which is greater than the second peripheral speed;

toner transferring means for causing, after the magnetic brush comprised of the carrier and the toner has been carried on said intermediate roller, transfer of the toner alone to said developing roller by making use of a DC bias developed between said intermediate roller and said developing roller;

developing means for making development by causing jumping of the toner by applying an AC bias having a superimposed DC component between said developing roller and said image carrier;

DC bias switching means for switching said DC bias when developing and when not developing; and said DC bias switching means causing, when developing, switching of the voltage level of said DC bias to be higher than the voltage level of said superimposed DC component of said AC bias, thereby causing the toner to undergo transfer motion between said intermediate roller and said developing roller to be transferred to said developing roller, and when not developing, switching of the voltage level of said DC bias to be lower than said superimposed DC component of said AC bias, thereby causing the toner to undergo recovery motion between said intermediate roller and said developing roller to be recovered to said intermediate roller.

* * * * *